United States Patent [19]

Osaka et al.

[11] Patent Number: 4,664,169

[45] Date of Patent: May 12, 1987

[54] VENETIAN BLIND CONSTRUCTION

[75] Inventors: Susumu Osaka; Midori Sagawa, both of Tokyo, Japan

[73] Assignee: RCA Corporation, Princeton, N.J.

[21] Appl. No.: 231,856

[22] Filed: Feb. 5, 1981

[51] Int. Cl.[4] ..... E06B 9/307; E06B 3/38

[52] U.S. Cl. ..... 160/107; 160/2; 160/168 R; 160/174; 160/176 R

[58] Field of Search ..... 160/107, 167, 168, 166, 160/172, 174, 176, 178 E, DIG. 16, DIG. 17, 178, 101, 174, 176 R

[56] References Cited

U.S. PATENT DOCUMENTS

| | | | |
|---|---|---|---|
| 262,399 | 8/1882 | Gibson | 160/176 X |
| 2,130,319 | 9/1938 | Hammer | 160/178 E |
| 2,146,816 | 2/1939 | Grassby, Jr. | 160/178 R |
| 2,149,481 | 3/1939 | Van Bosch et al. | 160/DIG. 17 |
| 2,152,117 | 3/1939 | Wade et al. | 160/168 |
| 2,276,425 | 3/1942 | Slattery | 160/19 |
| 2,288,465 | 6/1942 | Knudsen | 160/107 |
| 2,300,545 | 11/1942 | Gooch | 160/178 |
| 2,546,335 | 3/1951 | Friend | 88/57.5 |
| 3,032,099 | 5/1962 | Croxen | 160/168 |
| 3,106,240 | 10/1963 | Weber | 160/196 |
| 3,110,824 | 11/1963 | Flanagan | 49/31 X |
| 3,153,819 | 10/1964 | Bond | 160/107 X |
| 3,177,367 | 4/1965 | Brown | 250/227 |
| 3,211,264 | 10/1965 | Streeter et al. | 49/67 |
| 3,265,117 | 8/1966 | Lorentzen et al. | 160/174 |
| 3,318,360 | 5/1967 | Perrson | 160/107 |
| 3,389,737 | 6/1968 | Arnold et al. | 160/107 |
| 3,646,985 | 3/1972 | Klann | 160/168 |
| 3,722,572 | 3/1973 | Hall | 160/176 |
| 3,860,055 | 1/1975 | Wild | 160/1 |
| 3,872,911 | 3/1975 | Janes | 160/1 |
| 3,971,427 | 7/1976 | Coldeway | 160/166 R |
| 4,096,903 | 6/1978 | Ringle | 160/107 |

*Primary Examiner*—Ramon S. Britts
*Assistant Examiner*—Cherney S. Lieberman
*Attorney, Agent, or Firm*—Joseph S. Tripoli; William Squire

[57] ABSTRACT

A louvre assembly between two transparent covers of a housing comprises lightweight louvres suspended and pivoted by lightweight filaments. A counterbalanced beam for pivoting the louvres can be operated by an electrical driving arrangement such as one including a piezoelectric bimorph driver. The electrical power for operating the driver may be obtained from solar cells. A louvre guide system spaces the louvres from the transparent walls of the housing and guides the louvres.

8 Claims, 12 Drawing Figures

VENETIAN BLIND CONSTRUCTION

Figure 1:
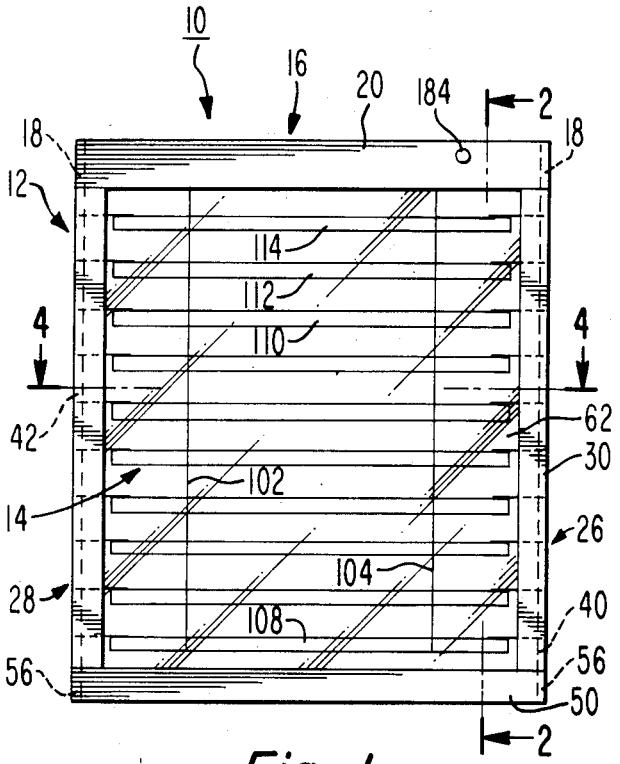

The present invention relates to venetian blind apparatus.

Of interest is copending application (RCA 74,122) entitled "Shutter Construction" by Susumu Osaka and Minoru Toda filed concurrently herewith and assigned to the assignee of this invention.

Venetian blind apparatus generally employ relatively bulky mechanisms for opening and closing the louvres. The louvres usually are relatively heavy and a number of tapes or cords strung within the field of view of the blind structure are used for operating the louvres. These detract from the appearance of the blind structure. Further, because of the relatively bulkiness and weight of the structure, substantial force is required for its operation. In terms of blinds operated by electrical power, conventional Venetian blinds, as described, are not easily operated by low power sources such as solar cells.

Normal use in the office, home or factory subject the louvres to physical abuse which tends to damage them. Conventional blinds hang by their own weight and strong air currents tend to move them and sometimes to damage portions of the suspended structure. Traditionally, when in use, the louvres tend to accumulate dust and dirt and require frequent cleaning, which may damage them and which in any case adds to the maintenance cost. A further disadvantage of conventional blinds is that disturbing outside sounds readily pass through the blind structure, particularly when the blades are in the open position.

According to an embodiment of the present invention, a Venetian blind construction includes an enclosed housing having first and second spaced light transparent walls through which rays of light may pass. A louvre array within the housing between the walls includes a plurality of spaced parallel louvres secured for rotation about parallel axes. Means are included for preventing the edges of the louvres from touching the housing walls. Drive means are secured to the housing and coupled to the louvres for opening and closing the louvres.

Figure 2:
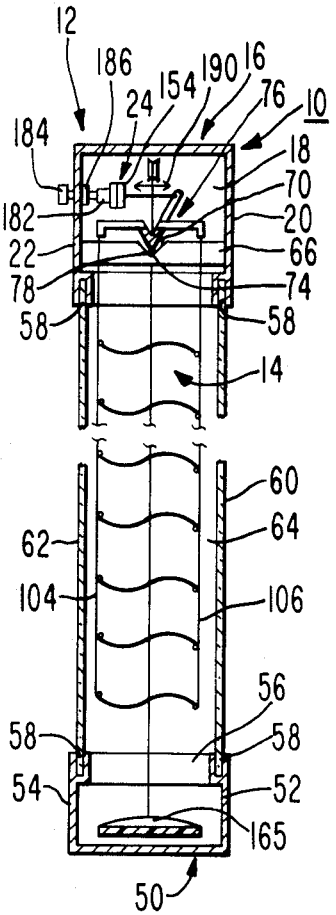
Figure 4:
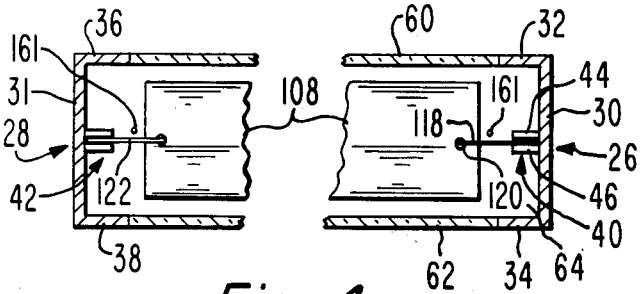
Figure 11:
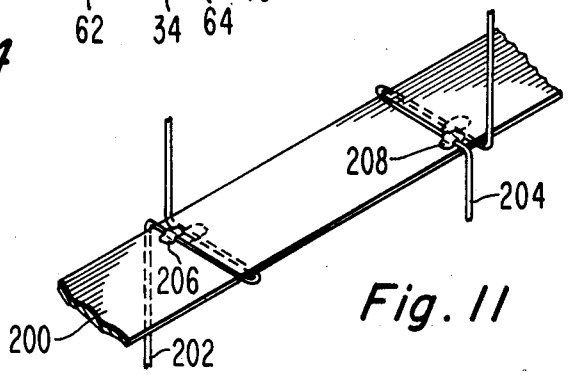
Figure 3:
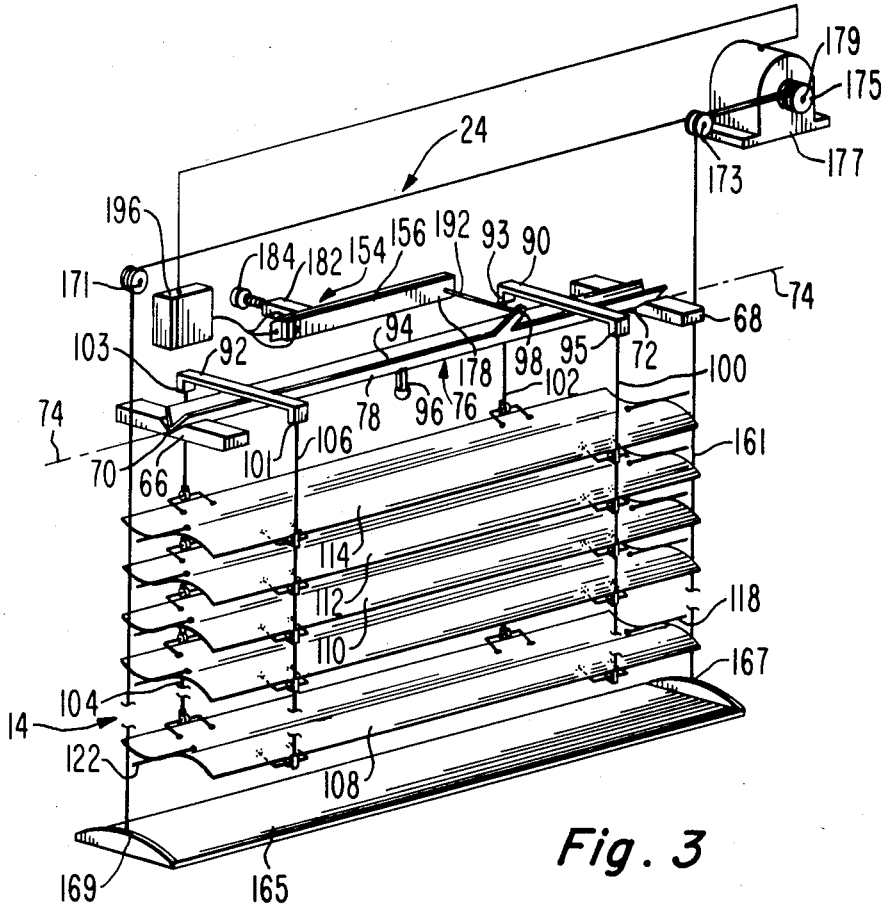
Figure 5:
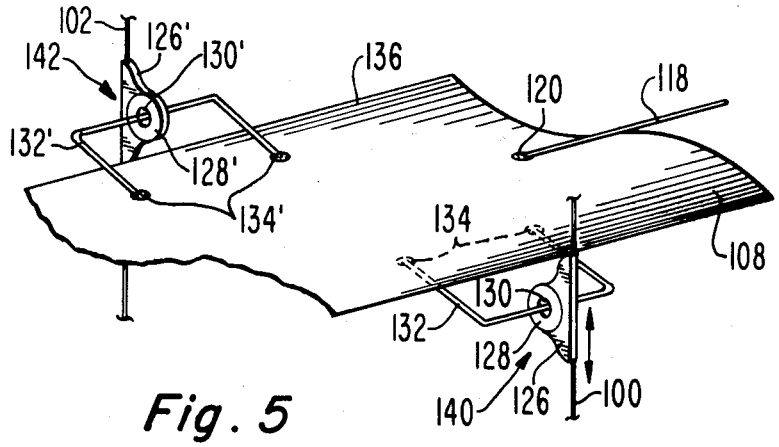
Figure 6:
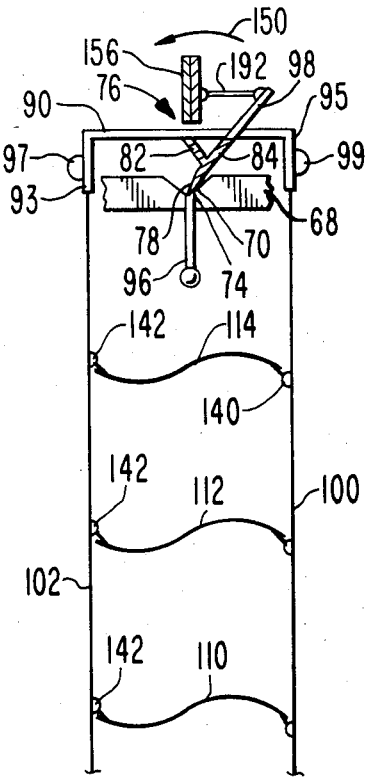
Figure 7:
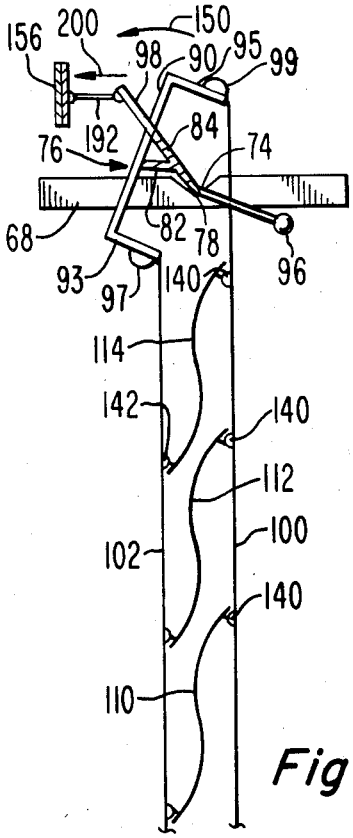
Figure 8:
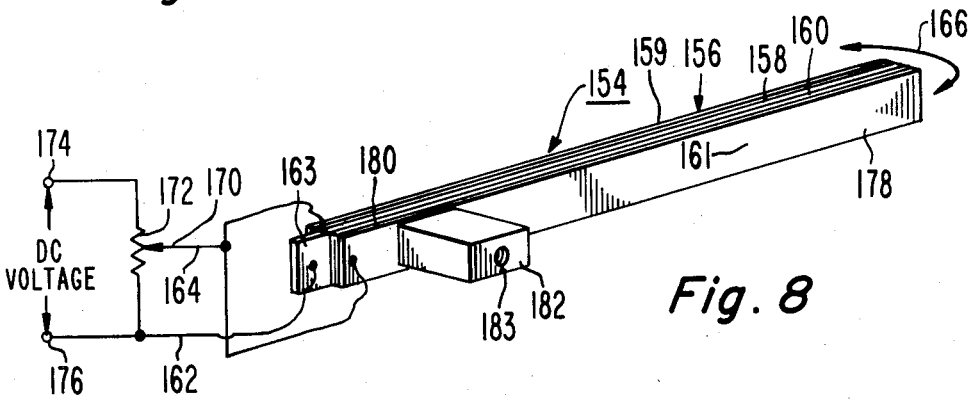
Figure 9:
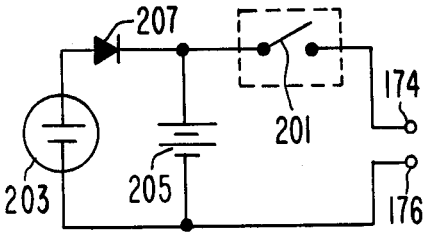
Figure 10A:
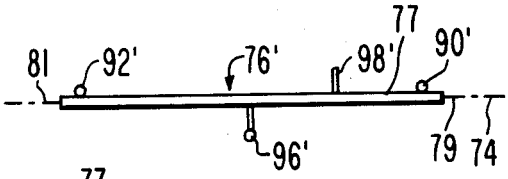
Figure 10B:
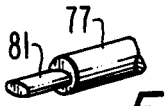

In the drawing:

FIG. 1 is a front elevation view of a Venetian blind construction embodying the present invention, FIG. 2 is a side fragmented, sectional elevation view of the construction of FIG. 1 taken along lines 2—2, FIG. 3 is an isometric partially schematic view of the operating mechanism of the embodiment of FIG. 1, FIG. 4 is a fragmented, sectional plan view taken along lines 4—4 of FIG. 1, FIG. 5 is a fragmented, isometric view of a portion of one louvre showing one embodiment of its attachment to the louvre operating system, FIG. 6 is a side, fragmented partially schematic sectional side view of the upper portion of the system of FIG. 3 illustrating the operating mechanism, FIG. 7 is a view similar to that of FIG. 6 showing the louvre assembly in a closed louvre condition, FIG. 8 is a partial schematic, isometric view of a piezoelectric bimorph drive device employed in the embodiment of the present invention, FIG. 9 is one electric drive circuit employing a solar cell used in driving the piezoelectric element of FIG. 8, FIGS. 10*a* and 10*b* are views of an alternate beam which may be employed in the embodiment of FIG. 3, and FIG. 11 is an isometric showing of an alternate embodiment for connecting a louvre to the louvre operating system.

In FIG. 1, Venetian blind assembly 10 comprises a light transparent housing 12 and a louvre assembly 14 enclosed within the housing 12. The assembly 14 louvres do not touch the housing walls which provide a dust-proof, sound insulating construction. The entire assembly can be easily transported as a portable cassette unit. Further, it is relatively maintenance free and has prolonged life in that the louvres are protected from damage and dirt.

The housing 12, FIGS. 1 and 2, comprises an upper sheet metal channel member 16 which has parallel facing end legs 18 and two downward depending respective rear and front parallel legs 20 and 22. The louvre operating mechanism 24 is secured within the channel of member 16. Two sheet metal end channels 26 and 28, FIGS. 1 and 4, are secured to the member 16 at the respective lower edges of legs 18. In FIG. 4, channel 26 includes an end wall 30 and side legs 32 and 34. Channel 28 comprises end wall 31 and legs 36 and 38; channel 26 comprises end wall 30 and legs 32 and 34. A channel shaped guide rail 40 is secured centrally to wall 30 along the length of channel 26 and channel shaped guide rail 42 is secured centrally of member 31 along the length of channel 28. The guide rails 40 and 42 face each other and are identical. Rails 40 and 42 each comprise two parallel legs 44 and 46 respectively secured to walls 30 and 31 at one of their edges.

Channel member 50 is secured to the lower end of channels 26 and 28. Member 50 has two upwardly extending respective parallel legs 52 and 54 opposite the legs 20 and 22, respectively of channel member 16. Channel member 50 also has two end legs 56 which are opposite and coextensive with the legs 18. The legs 20, 22 and 18 of member 16 and legs 52, 54 and 56 of channel 50 are each formed with grooves 58 of like dimensions for receiving two facing sheets 60 and 62 of transparent thermoplastic material. The respective transparent sheets 60 and 62 abut the edges of channel 26 legs 32, 34 and channel 28 legs 36 and 38, FIG. 4. In the alternative, they may be rceived within channels (not shown) at these edges. Sheets 60 and 62 alternatively may be made of glass or any relatively stiff (self supporting), light transparent material.

The structure comprising upper and lower respective members 16 and 50, end channels 26, 28 and transparent sheets 60, 62 is a light transparent enclosed housing having an interior chamber 64 which is sealed from the ambient. The seal is not hermetic but is sufficient very substantially to reduce the entrance of dust or dirt into the chamber 64, the passage of sound through the chamber, and damage to and mishandling of the louvres.

FIGS. 2 and 3 illustrate the louvre assembly 14 operating mechanism 24 which includes a pair of spaced, transverse, beam supports 66 and 68, each secured at its ends to legs 20 and 22. Supports 66 and 68 are preferably made of a low friction, thermoplastic material such as Teflon (trademark of the DuPont Corporation, Wilmington, Del.), a polytetrafluoroethylene. V-notches 70 and 72 in supports 66 and 68 respectively are aligned along a common axis 74 extending in a direction along the length of beam 76. Beam 76 has a knife edge 78 which is received within and engages the notches 70 and 72. Beam 76 may be V-shaped in cross section or, in the alternative, may have a shape as illustrated in FIGS. 6 and 7. In FIG. 6, beam 76 comprises intersecting legs 82 and 84. Leg 82 is secured to the lower portion of leg 84 at an angle of approximately 45°. Leg 84 extends beyond the leg 82 and terminates at its lower end in a knife edge 78. This knife edge is seated within notches 70 and 72.

A pair of cross arms 90 and 92, FIG. 3, are transversely secured symmetrically to the beam 76 at its upper edges. Cross arms 90 and 92 may be, for example, two rectangular or circular cylindrical metal or thermoplastic rods. The rods are balanced and centered over the knife edge 78 and are perpendicular to the axis 74. They are preferably equidistant from the longitudinal beam 76 center of gravity (C.G.) 94. A drive arm 98 which is used to rotate beam 76 about axis 74 via knife edge 78, extends upwardly from leg 84 of the beam. This arm may extend from leg 84 at an angle, by way of example, of about 45° from the horizontal as shown in FIG. 6. A counterbalance weight 96 may be secured to the knife edge 78 at the beam center of gravity (C.G.) to counterbalance arm 98 about axis 74. Arm 90 has at opposite ends thereof a pair of depending legs 93, 95, FIG. 6. Balance weights 97, 99 are respectively attached to legs 93, 95 to balance the beam 76 about axis 74. Beam 92 has similar legs 101, 103 (FIG. 3) and corresponding counterweights secured thereto.

An alternative structure for beam 76 is shown in FIG. 10*a*. Beam 76′ includes an elongated metal or thermoplastic circular cylindrical rod 77 having relatively small diameter pins 79 and 81 (fraction of a millimeter) secured at opposite ends thereof and lying in axis 74. Cross arms 90′ and 92′ are equidistant from the center of beam 76′. Arms 90′ and 92′ may comprise small diameter metal or thermoplastic rods. Pins 79 and 81 seat within notches 70 and 72 respectively, and act as knife edges as described above. Counterweight 96′ is suspended from beam 76′ at its center of gravity (C.G.) and it counterbalances arm 98′. This structure is very light and the counterweights 97, 99 of FIGS. 3 and 7 are omitted in this example. In FIG. 10*b*, the pin 81 (and 79) may be oval in cross section to provide improved stability to beam 76′.

A pair of filaments 100 and 102, FIGS. 3, 6 and 7, are attached at one end to respective legs 95, 93 at the ends of cross arm 90. A second pair of filaments 104 and 106, FIG. 3, are attached at one end to respective legs 103, 101 at the corresponding ends of cross arm 92. The filaments in one example are made of thermoplastic high strength translucent material and are commercially available as fishing lines known as "monofilament" lines. These can be of sufficiently small gauge such that they are relatively invisible. Attached to the filaments 100, 102, 104 and 106 are a plurality of identical parallel S-shaped louvres some of which are shown at 108, 110, 112, and 114, FIGS. 1, 3. The louvres are formed from hot-pressed aluminum having a thickness in the range of about 30–50 micrometers. They may also have a centrally positioned bend or rib (not shown) along the length of the louvre to strengthen it. The aluminum can be made highly reflective, if desired, to provide good reflectivity of incident light or alternatively can be treated in other ways-painted or anodized as examples. The louvres, by way of example, may be 4+50 centimeters and weight 2.3 grams each.

Wire 118, FIG. 5, is attached to one end of louvre 108 by epoxy 120. A second wire 122, FIG. 3, at the other end of louvre 108 is aligned with wire 118 along an axis parallel to axis 74 (FIG. 3) through the center of gravity of the louvre. The wires 118, 122 are formed, by way of example, from relatively stiff steel wire such as piano wire having a diameter of 0.3–0.4 millimeters. Wires 118 and 122 have their ends engaged in the channels of channel members 40 and 42, FIG. 4. All of the louvres have channel engaging wires similar to wires 118, 122 at their respective ends, FIG. 3.

The wires 118 and 122 when engaged in channels 40 and 42 serve to guide the louvres in the vertical direction as they are displaced with respect to each other and also restrain the louvres centrally within the chamber formed by the housing 12 so that the louvres do not touch or scrape against the transparent sheets 60 and 62, FIG. 2.

A connection assembly 140, between a louvre, such as louvre 108 and a filament, such as filament 100, is shown in FIG. 5. Filament 100 is secured to louvre 108 via connector 126. Connector 126 includes a Teflon or other low friction bushing 128 having an aperture 130. Relatively stiff U-shape wire 132 which may be formed of the same material as wire 100, but which preferably is of smaller diameter than wire 100, is secured at the free ends of legs to the underside of louvre 108 by epoxy 134 and its cross leg passes through aperture 130. At the opposite edge 136, connection assembly 142 connects filament 102 to louvre 108 in similar fashion. However, the wire 132′ is fixed to the upper surface of louvre 108 rather than to the lower surface. Filaments 104 and 106, FIG. 3, are secured to the remaining louvres in similar fashion. This construction provides a relatively lightweight, low friction interconnection system between the filaments and the individual louvres providing almost relatively friction-free movement between the two. The mechanism comprising the beam 76, cross arms 90, 92 and the filaments 100–106 suspended from the cross arms are balanced as much as possible about the pivot axis 74 in the directions 150, FIGS. 6 and 7, to reduce the magnitude of the force required to rotate beam 76 and the attached louvres. An alternate construction for securing the louvres to the filaments with low friction is shown in FIG. 11. Louvre 200 is secured to filaments 202 and 204 which open and close the louvre. Filament 202 may be connected to leg 93, FIG. 3, and filament 204 to leg 95. The filaments are wrapped around the louvre as shown. Small drops 206 and 208 of epoxy may be used to secure the respective filaments 202 and 204 to the louvres. Drops 206 and 208 are spaced from the edges of the louvre to permit the louvre to pivot. Assuming some finite thickness to the louvre, the contact points between a filament at a louvre edge and the louvre edge will displace somewhat as the louvre rotates. By not epoxying the filament at the edges, this freedom for the filament contact points to displace minimizes friction losses due to bending of the filament which would otherwise occur at the connection point.

Still other embodiments for attaching the filaments to the louvres may include attaching small balls to the filaments, one for each filament-louvre combination support, passing the filament through an opening in the louvre so the louvre rests on a corresponding ball at that support location. The louvre may have a slotted aperture for passing the filament and ball structure through the various louvres to the ball's desired position beneath a given louvre. Other arrangements include small rings or other circular devices attached to the filaments or formed by the filaments to provide a relatively low friction support for each of the louvres.

In FIGS. 3 and 8, drive 154 comprises a piezoelectric bimorph device 156. The bimorph device 156, FIG. 8, employs two piezoelectric strips 158 and 160 separated by a conductive foil 163. Deposited on the outer face of strip 160 is a thin conductive layer 161 and on the outer face of strip 158 is a thin conductive layer 159. Outer conductive layers 159, 161 are connected at one end to lead 164 and center conductive foil 163 is connected to lead 162. The bimorph may be made of polymer materials such as Polyvinylidene Flouride Resin Film ($PVF_2$). It is oriented to move in the horizontal plane so as to not be affected by gravity. When a DC voltage is applied to leads 162, 164, the device 156 tends to bend in one of directions 166 in a horizontal plane normal to the plane of the layer 158, 160. This is due to the electrostatic field created by layers 159, 161 and foil 163. Lead 164 is connected to tap 170 of potentiometer 172, the latter being connected between DC voltage supply terminals 174 and 176. Lead 162 is connected to terminal 176 and to one end of potentiometer 172. The value of the voltage picked off the potentiometer determines the amount of displacement of device 154 at cantilevered end 178. The device 154 is mounted at its end portion 180, to an electrically insulating adjustment block 182 having a threaded bore 183. The block is secured to screw 184 which is threaded to nut 186 secured to leg 22, as shown in FIG. 2. Displacement of the screw 184 adjusts the displacement of block 182 in directions 190 (FIG. 2) and thus the device 156 with respect to leg 22. While a single device 156, FIG. 8, is shown, an array of such devices in parallel could be employed to increase their power.

In FIG. 3, link 192 connects device 156 to arm 98. Link 192 has a flexible adhesive epoxy bead connecting its ends respectively to bimorph device 156 at end 178 and to arm 98 at its upper end. With no voltage applied to device 156, screw 184 adjusts the device 154 position with respect to the axis 74, FIG. 3. This rotates the beam 76 about axis 74 via link 192 and drive arm 98. Since the louvres are connected to beam 76 by filaments 100, 102, 104 and 106, this adjustment orients the louvres 110-114 about parallel horizontal axes. This adjusts the louvres to a horizontal orientation which is their normally open configuration.

Control 196, FIG. 3, may comprise a source of DC voltage and the bimorph drive system of FIG. 8 described above. In FIG. 7, when the bimorph device 156 moves in the direction 200, arm 98 via link 192 follows and pivots beam 76 at knife edge 78 mounted on supports 68, 70 (FIG. 3), rotating the beam 76 in direction 150 about axis 74. This orients the louvres counterclockwise, FIG. 7, a maximum distance of 90° from the horizontal open state position, FIG. 6. In FIG. 7, the connection of the filaments 100, 102 to the lower and upper surfaces of the louvres such as louvres 114, 112 and 110, limits the rotation of the louvres in this counterclockwise direction. Of course, if the filaments were connected to the louvre edges in connection with the description of the embodiment of FIG. 11, then the louvres could be rotated 180° instead of 90° if desired.

The tap 170, FIG. 8, may be controlled manually or electronically for orienting the louvres to any desired position between that shown in FIGS. 6 and 7. The pins 118 and 122, FIG. 4, due to their relatively small diameters provide a bearing surface which approximates a "knife edge" and rotate relatively friction free within the channel members 40 and 42 during this orientation.

It is also desirable to not only rotate the louvres about parallel horizontal axes but also to stack the louvres one against the other by lifting the bottommost louvre 108, FIG. 3, until it abuts against next adjacent louvre 110, and so forth until all of the louvres are stacked close together at the upper end of the housing 12. This action clears the opening of all louvres. To accomplish this, a continuous string 161, FIG. 3, is connected at one end to a support 165 via upstanding member 167 and at its other end to support 165 upstanding member 169. The string 161 is wrapped around pulleys 171, 173 and terminated at pulley 175 attached to motor 177 drive shaft 179. Rotation of the pulley 175 wraps the string 161 around it and draws the support 165 toward the arm 76. This stacks all of the louvres between support 165 and the arm 76. The pins 118 and 122 attached to the louvres slide in the channels 40, 42, FIG. 4, which channels prevent the louvres from contacting or rubbing against the transparent housing walls 60 and 62 during this action. Upstanding members 167, 169 also have slots (not shown) to receive the pins 118 and 122. The support 165 may be made out of light-weight, high-strength materials, such as molded styrofoam or other thermoplastic materials.

The control 196 is connected to and controls motor 177. This control can also be remote. For example, control 196 may include a receiver which is operated by a remote control transmitter, which opens and closes a switch, turning on and off any current to the piezoelectric device 156. By way of example, in FIG. 9, a simplified schematic representation of a solar cell power source is shown. A remotely or manually operated switch 201 is connected between terminal 174 and one terminal of solar cell 203 through diode 207. Terminal 176 is connected to the other terminal of solar cell 203. While one cell is shown, in practice this could be an array. Battery 205 is connected across diode 207 and cell 203. In practice this could be a bank of batteries. The solar cell 203 may be placed on a side of the housing 12, FIG. 1, facing the incident light to be controlled, or on a side of the louvre assembly opposite the light source so it responds to the transmission of light through the louvre assembly. The solar cell 203 charges the battery 205 in the presence of solar energy and when the switch 201 is closesd, operates the piezoelectric device 165. At night the battery 205 operates the device 156 and motor 177 (FIG. 3). In the alternative, a conventional power source can power the device of FIG. 8. It should be understood that the circuit of FIG. 9 is intended only as a schematic circuit to illustrate the principles involved.

The steel wire 132, FIG. 5, which supports the louvres, may be 0.3 to 0.4 millimeters in diameter. In this case, the pins 118 and 122 at the ends of each of the louvres may be 0.6 millimeter diameter steel wire. The louvres may have a thickness to 50 micrometers, a 4 centimeter width and a 100 centimeter length, and weigh 4.6 grams each. It can be shown that the power in watts required to overcome friction for operating a Venetian blind $1 \times 1$ square meter comprising 27 louvres through one operating cycle with steel wires 118, 122 connected to Teflon connectors as shown in FIG. 5, is 0.065 milliwatts. The power for overcoming the friction between the steel wires and their connecting beads is 0.025 milliwatts. The power required to overcome the knife edge friction of the main shaft and balance arm which may weight 80 grams with Teflon supports 66 and 68 is 0.04 milliwatts. The above employs a drive arm 98 which has a length between 5 and 8 millimeters and the ceramic bimorph piezoelectric device has a length of 150 millimeters, a thickness of 0.6 millimeters and a width of 20 millimeters. Tests have shown that a 0.6×3×150 millimeter parallel type ceramic bimorph device moves one centimeter at its extended tip when activated with 60 volts and produces a 0.6 gram force at that extended tip. An array of bimorphs can be provided to increase their drive power. The bimorph drive voltage can be supplied by an array of solar cells, by transformer coupling to a utility line, household line or other sources. By altering the bimorph length, voltage, etc. the particular input and output power requirements for a given implementation can be provided. The above particulars are given by way of illustration.

The ceramic bimorph or piezoelectric device 156 in operating the louvres moves the louvres from a horizontal to a vertical orientation in one direction only. That is, the cross arms 90, 92, FIGS. 3, 6 and 7, are tilted only in the direction 150 from the horizontal. The magnitude of the displacement of the end 178 of the piezoelectric device can be changed by altering its length as well as by altering the voltage applied thereto. The longer the device, the greater its displacement. By providing relatively low friction between all of the operating elements, and relatively lightweight material as described, a low force piezoelectric device can be utilized to provide economical, low power operation.

In alternative forms of the invention, the beam 76' FIG. 10*a*, may be driven by a rack and pinion arrangement. A pinion may be secured to rod 77 and a rack operated by link 192 (FIG. 3) may be connected to an end of link 192. The rack would be driven in direction 200, FIG. 7. Also other drive means for orienting the louvres may include conventional motors and pulley or gearing arrangements.

What is claimed is:

1. A Venetian blind construction comprising:

an enclosed housing having first and second spaced light transparent walls through which rays of light may pass, a louvre array within said housing between said walls including a plurality of spaced parallel louvres secured for rotation about parallel axes, said louvres permitting said rays to pass through said Venetian blind when in one orientation and blocking said rays when in a second orientation, means coupled to said louvres for preventing their edges from touching the walls of said housing, and drive means secured to said housing and coupled to said louvres for opening and closing said louvres, said drive means including support means coupled to said housing and having a notch therein extending parallel to said axes, a beam with a knife edge, said beam having its knife edge in said notch parallel to said axes for pivotally securing the beam to the support means for rotation about a pivot axis defined by said knife edge and parallel to said axes, and filaments secured to said beam in spaced relation to said knife edge and to said louvres for rotating said louvres about said parallel axes in response to the rotation of said beam about said pivot axis, said beam including a drive arm offset from said pivot axis and a counterweight for counterbalancing said drive arm with respect to said pivot axis.

2. The construction of claim 1 wherein said louvres each comprise like curved foil slats, and wherein said means for preventing includes restraining means coupled to said housing and louvres to position the louvres in spaced relation with respect to said walls.

3. The construction of claim 2 wherein said restraining means includes first and second channels spaced at opposite sides of said housing, said louvres each including first and second channel engaging means secured at opposite ends of that louvre, each engaging means being engaged with a different one of said channels.

4. The construction of claim 1 wherein said drive means includes a piezoelectric device coupled to said housing and said drive arm for operating said drive arm.

5. The construction of claim 1 wherein said drive means further includes photoelectric generating means for generating an electric signal for operating said drive means in response to incident light.

6. A Venetian blind construction comprising:

a housing forming an enclosed chamber, said chamber including two facing light transparent walls, a support means coupled to said housing and having a notch extending along a given axis, a beam with a knife edge, said beam having its knife edge in said notch to thereby pivotally secure the beam to said housing, with said beam pivoting about an axis of rotation defined by said knife edge and parallel to said given axis, a set of spaced parallel louvres parallel to said axis of rotation suspended from said beam by a plurality of light translucent filaments at points along the opposite, parallel longer edges of said louvres, said louvres being spaced between said transparent walls, means for pivoting said beam about said axis of rotation and thereby rotating said louvres in unison about a plurality of axes parallel to said axis of rotation, means secured to the housing and to said louvres for raising the louvres and stacking them one against the other at the upper portion of the Venetian blind, and guide means for guiding said louvres while they are being raised and for holding said louvres in spaced relation with respect to said walls, said means for pivoting including a piezoelectric device, a drive arm connected to said beam, and a connecting link secured to said device and said drive arm.

7. The construction of claim 6 wherein said filaments are coupled to said louvres with connecting means, said connecting means each comprising a wire secured to a louvre, and an apertured bearing secured to said filaments, said wire passing through said bearing aperture.

8. A Venetian blind construction comprising:

an enclosed housing having first and second spaced light transparent walls through which rays of light may pass, a louvre array within said housing between said walls including a plurality of spaced parallel louvres secured for rotation about parallel axes, said louvres permitting said rays to pass through said Venetian blind when in one orientation and blocking said rays when in a second orientation, means coupled to said louvres for preventing their edges from touching the walls of said housing, and drive means secured to said housing and coupled to said louvres for opening and closing said louvres, said drive means including support means coupled to said housing and having a notch therein extending parallel to said axes, a beam with a knife edge, said beam having its knife edge in said notch extending parallel to said axes for pivotally securing the beam to the support means for rotation about a pivot axis defined by said knife edge and parallel to said axes, and filaments secured to said beam in spaced relation to said knife edge and to said louvres for rotating said louvres about said parallel axes in response to the rotation of said beam about said pivot axis, said beam including a drive arm offset from said pivot axis and a counterweight for counterbalancing said drive arm with respect to said pivot axis, said drive means including a piezoelectric device coupled to said housing and said drive arm for operating said drive arm and a length of relatively stiff wire connected to said drive arm at one end and said piezoelectric device at the other end, and a flexible adherent material for securing said ends.

* * * * *

UNITED STATES PATENT AND TRADEMARK OFFICE
CERTIFICATE OF CORRECTION

PATENT NO. : 4,664,169

DATED : May 12, 1987

INVENTOR(S) : SUSUMU OSAKA ET AL.

It is certified that error appears in the above-identified patent and that said Letters Patent is hereby corrected as shown below:

The following information is missing from the Title Page:

[30] Foreign Application Priority Data
Sep. 2, 1980 [GB] United Kingdom ..... 28229/80

Column 3, line 62, "4+50" should be --4x50--

Column 3, line 63, "weight" should be --weigh--

Column 6, line 42, "closesd" should be --closed--

Column 6, line 64, "weight" should be --weigh--

Signed and Sealed this

Second Day of February, 1988

*Attest:*

DONALD J. QUIGG

*Attesting Officer*

*Commissioner of Patents and Trademarks*